US006978845B2

(12) United States Patent
Leinemann

(10) Patent No.: US 6,978,845 B2
(45) Date of Patent: Dec. 27, 2005

(54) FLAME BARRIER ARRANGEMENT

(75) Inventor: Christoph Leinemann, Braunschweig (DE)

(73) Assignee: Leinemann GmbH & Co., Braunschweig (DE)

( * ) Notice: Subject to any disclaimer, the term of this patent is extended or adjusted under 35 U.S.C. 154(b) by 582 days.

(21) Appl. No.: 10/097,386

(22) Filed: Mar. 15, 2002

(65) Prior Publication Data

US 2002/0129947 A1 Sep. 19, 2002

(30) Foreign Application Priority Data

Mar. 17, 2001 (DE) ..... 101 129 57

(51) Int. Cl.[7] ..... A62C 2/00; A62C 8/00

(52) U.S. Cl. ..... 169/48; 169/49; 169/45; 169/46

(58) Field of Search ..... 169/48, 49, 45, 169/46; 431/346, 202, 246; 48/192

(56) References Cited

U.S. PATENT DOCUMENTS 5,402,603 A * 4/1995 Henley ..... 48/192
5,415,233 A * 5/1995 Roussakis et al. ..... 169/48
5,816,333 A * 10/1998 Audic et al. ..... 169/48
5,974,750 A * 11/1999 Landin et al. ..... 52/396.01

* cited by examiner

*Primary Examiner*—Davis Hwu
(74) *Attorney, Agent, or Firm*—Whitham, Curtis & Christofferson, P.C.

(57) ABSTRACT

In a flame barrier arrangement (1), having at least two flame barrier elements (2) which are arranged one behind the other in the direction of flow of a combustible gas and have a multiplicity of gaps for extinguishing a flame impinging on the surface of a flame filter element (2), and having at least one spacer element (5) between flame fattier elements (2), in order to produce a space between adjacent flame barrier elements (2) one spacer element (5) is securely joined, at least at certain points, to the surface of an associated flame barrier element (2).

12 Claims, 4 Drawing Sheets

FLAME BARRIER ARRANGEMENT

BACKGROUND OF THE INVENTION

1. Field of the Invention

The invention relates to a flame barrier arrangement, having at least two flame barrier elements which are arranged one behind the other in the direction of flow of a combustible gas and have a multiplicity of gaps for extinguishing a flame impinging on the surface of a flame barrier element, and having at least one spacer element between flame barrier elements, in order to produce a space between adjacent flame barrier elements.

2. Background Description

Flame-arresting fittings having a flame barrier, which prevents the spread of flames from explosions, detonations or permanent fires and therefore prevents flames from breaking through, are used to protect against explosions, detonations and permanent fires. A wide range of different designs of flame barriers are known and can be categorized substantially as static dry flame barriers, static wet flame barriers and dynamic flame barriers.

Most flame-arresting fittings which are currently in use are equipped with static dry flame barriers. These are elements in which use is made of the discovery that flames are no longer able to react within tight gaps, maintaining suitable limit dimensions, and therefore are made to go out. In this case, a flame is generally extinguished by intimate contact between the flame and cooling walls, e.g. by guiding the flame through narrow gaps.

Flame barriers of this type can be designed as narrow-mesh screens, plate safety features, sintered metals, beds of beads and strip safety features. The essential factor is that the flame barrier gaps which are selected for safety can be reproducibly maintained within very tight tolerances. Therefore, nowadays, it is primarily strip safety features which are used, these features being produced by winding up in each case one smooth strip and one corrugated strip. The corrugated strip is provided with corrugations which are straight or directed to the left or right and define the gap width, which is in the range from 0.2 to at most 1.5 mm, depending on the explosive mixture.

Depending on the type of flame-arresting fitting (explosion, detonation or permanent fire safety features), two, three or more strip securing discs are combined as flame barrier elements, optionally together with a surrounding cage in order to increase the mechanical strength, to form a complete flame barrier.

A flame barrier of the generic type is disclosed, for example, in EP 0 375 455 A2, which shows a flame-arresting fitting with a flame barrier comprising four flame barrier elements which are arranged one behind the other in the direction of flow of a combustible gas. Narrow spaces which create an expansion zone for the gas in the gaps and lead to turbulent flow of the gas are provided between the individual flame barrier elements. The spaces are produced by spacer elements between the flame barrier elements.

The conventional spacer elements are usually laid loosely between the flame barrier elements during assembly of a multilayer flame barrier. The spacer elements are in this case formed, for example, from a continuous triangular, polygonal or loop-like wire ring.

Particularly in the case of flame barriers with relatively large diameters, the conventional spacers offer only insufficient mechanical strength. The relatively expensive flame barrier elements can easily be destroyed in the event of dismantling or cleaning. Under high loads, in particular in the event of unstable detonations, the flame barrier elements are deformed when using the conventional spacers, so that the space between adjacent flame filter elements is reduced.

SUMMARY OF THE INVENTION

Therefore, it was an object of the invention to provide an improved flame barrier of the generic type.

The object is achieved by the flame barrier having the features of the main claim as a result of the fact that one spacer element is securely joined, at least at certain points, to the surface of an associated flame barrier element.

The secure joint between a spacer element and flame barrier element significantly increases the mechanical strength of the flame barrier elements, so that even flame barrier elements of relatively large dimensions, e.g. up to 1600 mm, can be fitted and dismantled, transported and cleaned without mechanical damage.

The connection of the spacers preferably takes place in a punctiform manner, e.g. using the spot-welding process, so that the surface area of the flame barrier element which is available for the passage of gas and liquid is not reduced unnecessarily.

The spacer elements are preferably shaped in such a way that they form bearing points which are distributed over the entire surface of the corresponding strip safety element, so that the bending of the strip safety elements under a compressive load is prevented. By contrast, the conventional spacer elements only offer non-uniformly distributed bearing surfaces which, moreover, in some cases only offer bearing points in the outer peripheral region of the flame barrier elements.

It is particularly advantageous if the bearing points of a spacer element are distributed uniformly over the surface of the corresponding flame barrier element. For this purpose, the spacer element may, for example, be in grid form.

The spacer elements may be formed from wire grid, woven wire fabric and/or from round bars.

BRIEF DESCRIPTION OF THE DRAWINGS

The invention is described in more detail below with reference to the appended drawings, in which.

DESCRIPTION OF PREFERRED EMBODIMENT OF THE INVENTION

Figure 1:
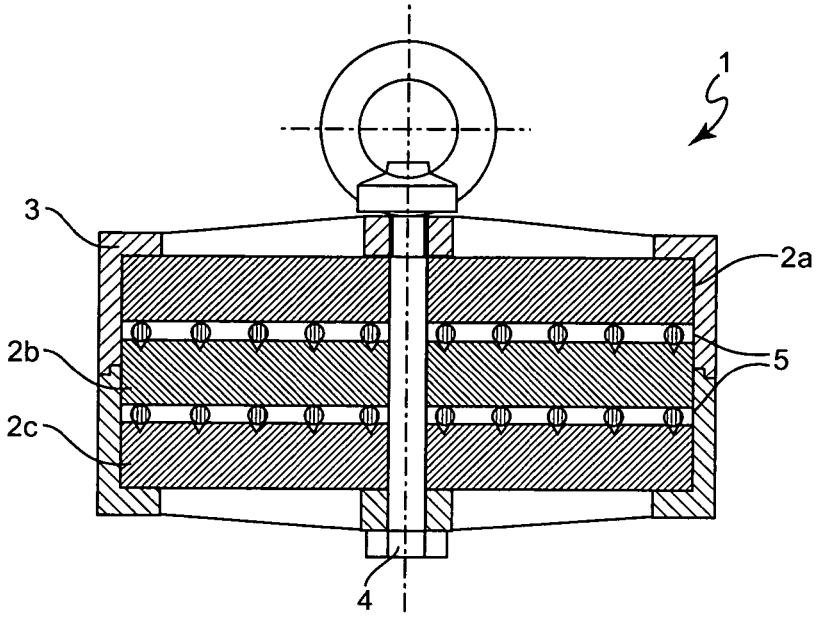
FIG. 1 shows a cross-sectional view of a complete flame barrier with three flame barrier elements arranged one behind the other in the direction of flow of a combustible gas, and spot-welded spacer element.

FIG. 1 shows a flame barrier 1 with three flame barrier elements 2*a*, 2*b*, 2*c* which are arranged one behind the other in the direction of flow of a combustible gas and are fitted into a surrounding cage 3. The surrounding cage 3 is in two parts, so that the flame barrier elements 2*a*, 2*b*, 2*c* can be readily fitted and subsequently dismantled for replacement and cleaning. The two parts of the surrounding cage 3 are held together by a screw connection 4.

It can be seen that a space is ensured between in each case two adjacent flame barrier elements 2*a*, 2*b* and 2*b*, 2*c* with the aid of spacer elements 5.

If a flame impinges on the generally circular surface of the flame barrier, the flame is cooled, with the aid of a multiplicity of gaps in the flame barrier elements 2*a*, 2*b* and 2*c*, to such an extent that it goes out. Moreover, the spacers ensure a turbulent flow, which promotes cooling and extinguishing of the flame.

Figure 2:
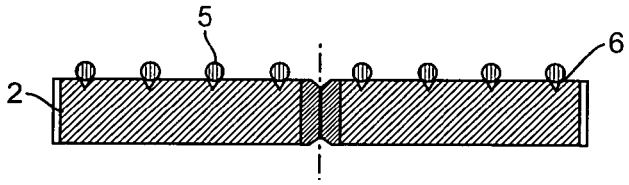
FIG. 2 shows a cross-sectional view of a flame barrier element with spot-welded spacer element.
Figure 12:
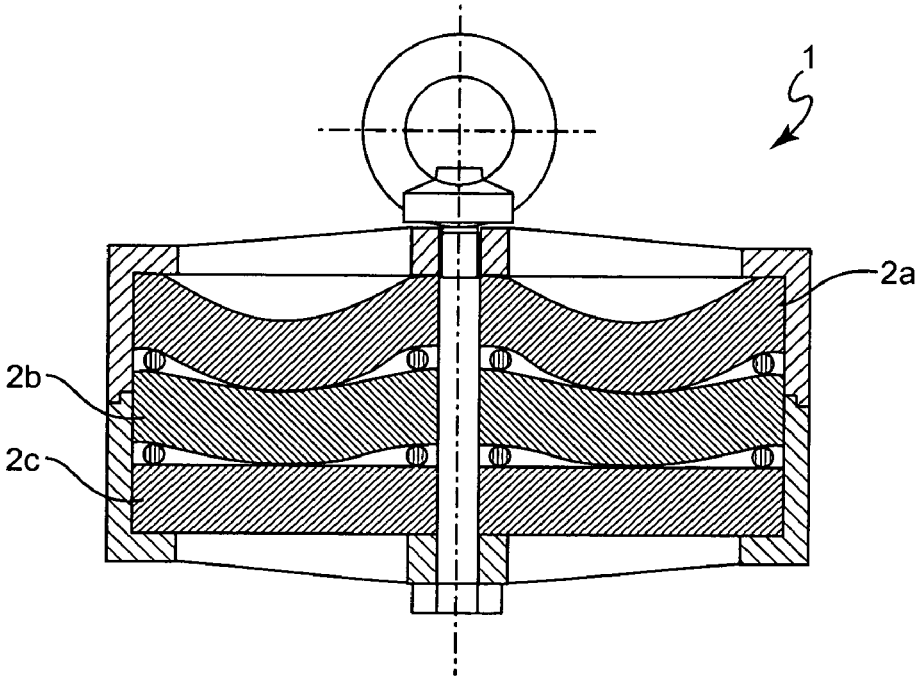
Figure 12 (Prior Art)
FIG. 12 shows a cross-sectional view of a flame barrier with three flame barrier elements which are arranged one behind the other in the direction of flow of a combustible gas and are deformed by compressive load.

FIG. 2 shows a cross-sectional view of a flame barrier component with a flame barrier element 2, on the surface of which a spacer element is arranged. According to the invention, the spacer element 5 is securely joined to the surface of the flame barrier element 2, preferably by spot-welded joints 6. In this way, the flame barrier component is stabilized, and mechanical damage during dismantling or cleaning, and also deformation of the flame barrier component in the event of a detonation wave impinging on it (as illustrated in FIG. 12), is prevented.

Figure 3:
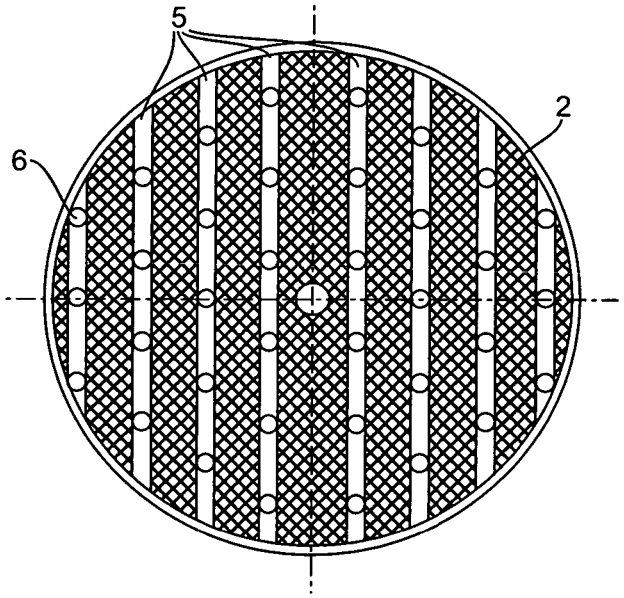
FIG. 3 shows a plan view of the flame barrier element from FIG. 2.

FIG. 3 shows a plan view of the flame barrier component from FIG. 2. It can be seen from this figure that the spacer element 2 comprises a multiplicity of parallel rods, which are arranged at a distance from one another and, uniformly distributed over the entire surface of the flame barrier element 2, form bearing points for an adjacent flame barrier component. This effectively prevents the flame barrier element 2 from bending under a compressive load, in particular in the event of a detonation wave impinging on it.

Figure 4:
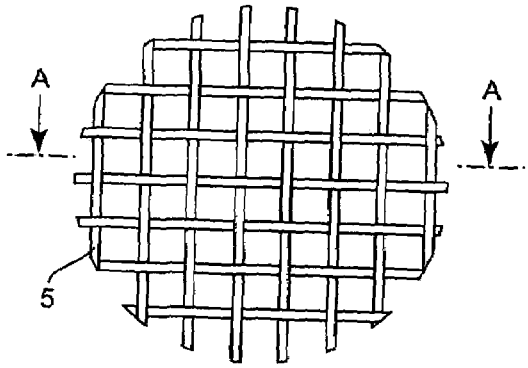
FIG. 4 shows a plan view of a spacer element which is formed from a woven wire fabric.
Figure 5:
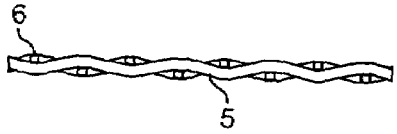
FIG. 5 shows a cross-sectional view of the woven wire fabric spacer element from FIG. 4.
Figure 6:
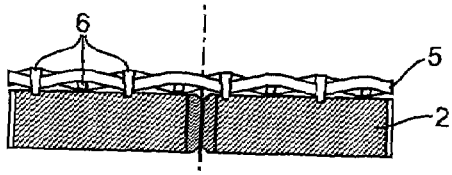
FIG. 6 shows a cross-sectional view of a flame barrier element with spot-welded woven wire fabric spacer element.

FIG. 4 shows an advantageous embodiment of a spacer element 2 which is formed from a woven wire fabric. At the intersection points of the woven wire fabric, the spacer element 5 is spot-welded to the associated flame barrier element 2, as can be seen from the cross-sectional views shown in FIGS. 5 and 6.

Figure 7:
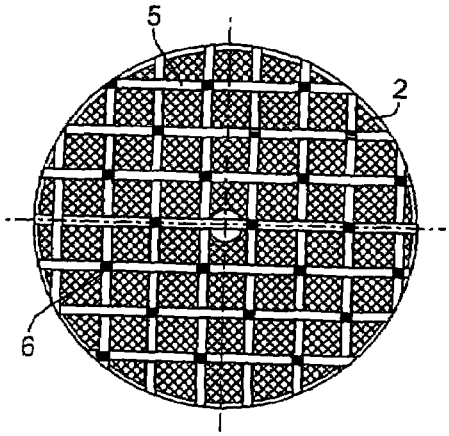
FIG. 7 shows a plan view of the flame barrier, element with spot-welded woven wire fabric spacer element from FIG. 6.

FIG. 7 shows a plan view of a flame barrier element 2 together with the spacer element, which is in the form of a wire grid, which spacer element, uniformly at every other intersection point, has a spot-welded joint 6 with the flame barrier element 2.

Figure 8:
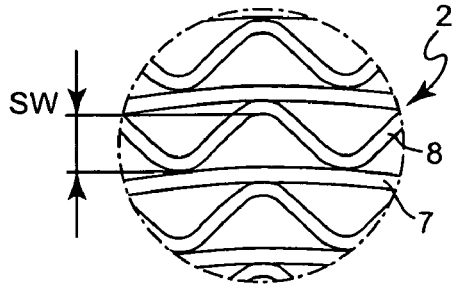
Figure 8 (Prior Art)
FIG. 8 shows part of a plan view of a flame barrier element in the embodiment of a strip safety element.

FIG. 8 shows a flame barrier element 2 in the embodiment of a strip safety element, as a plan view of part of such an element. The strip safety element is formed from a smooth strip 7 and a corrugated strip 8 above it, which are wound together helically. The smooth strip 7 and the corrugated strip 8 are usually about 10 mm wide.

The corrugation in the corrugated strip 8 defines the gaps. Depending on the medium for which the strip safety element is designed, the gap width SW is in the range from less than 0.2 mm to at most 1.5 mm.

Figure 9:
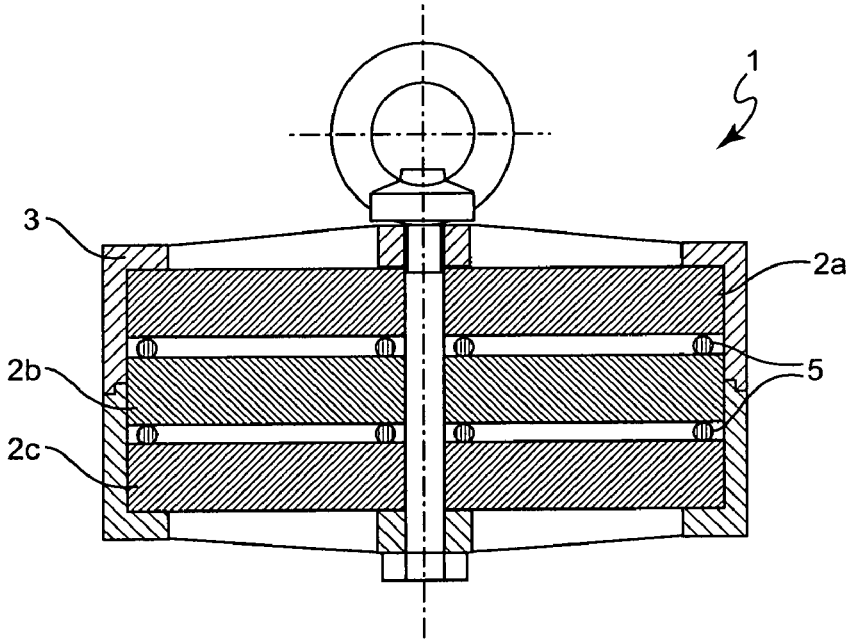
Figure 9 (Prior Art)
FIG. 9 shows a cross-sectional view of a conventional flame barrier with three flame barrier elements arranged one behind the other in the direction of flow of a combustible gas and non-uniformly laid out spacer elements at the outer and inner peripheries of the flame filter elements.

FIG. 9 shows a conventional flame barrier 1 with three flame barrier elements 2*a*, 2*b* and 2*c* which are arranged one behind the other in the direction of flow of a combustible gas and are fitted in a surrounding cage 3. Unlike the flame barrier 1 according to the invention, the spacer elements 5 are fitted loosely between the flame barrier elements 2*a*, 2*b*, 2*c* and only lie non-uniformly on the surface of the corresponding flame barrier element 2*a*, 2*b* or 2*c*.

Figure 10:
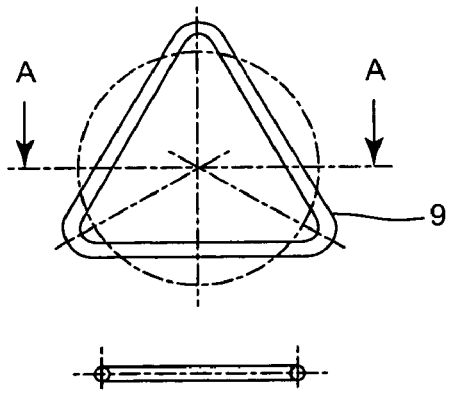
Figure 10 (Prior Art)
FIG. 10 shows a plan view and cross-sectional view of a triangular spacer element.

FIG. 10 shows an embodiment of a conventional triangular spacer element 9, which is inserted loosely between the flame barrier element 2. It can be seen from the cross-sectional illustration that the spacer element 9 is formed from a round wire.

Figure 11:
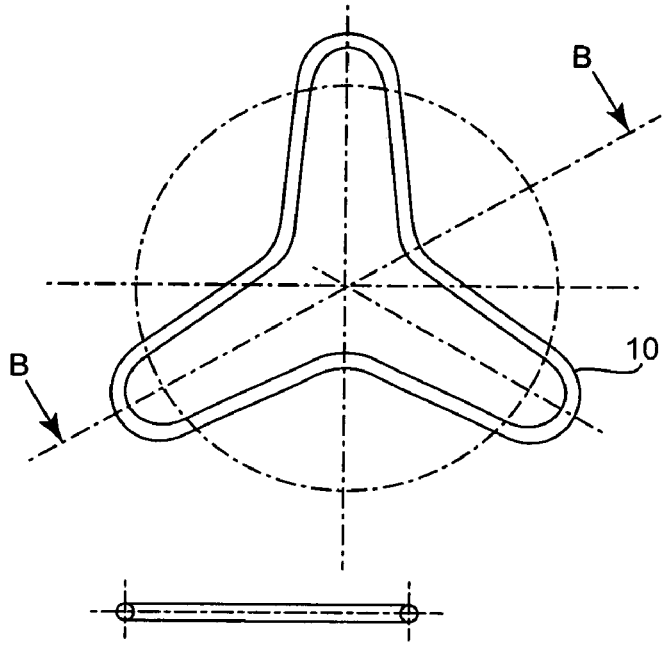
Figure 11 (Prior Art)
FIG. 11 shows a plan view and a cross-sectional view of a spacer element in loop form.

FIG. 11 shows another embodiment of conventional spacer element 10 in loop form, which is likewise inserted loosely between the flame barrier elements 2 and lies non-uniformly over the surface of the corresponding flame barrier element 2. The cross-sectional illustration reveals that the spacer element 10 is likewise formed from a round wire, and the bearing surface, in cross section, is distributed non-uniformly over the surface of the corresponding flame barrier element 2.

As can be seen from the cross-sectional illustration of a flame barrier 1 under compressive load in FIG. 12, for example in the event of a detonation, the flame barrier elements 2*a* and 2*b* are deformed under compressive load, so that the spaces between the flame barrier elements 2*a*, 2*b* and 2*c* are bridged. This may result in a flame breaking through. Unlike the flame barrier 1 illustrated in FIG. 1, with a spacer element 5 positioned uniformly over the entire surface of the corresponding flame barrier element 2, the flame barrier elements 2*a* and 2*b* can bend, since the conventional spacer elements 9, 10 form a support for the corresponding flame barrier element 2*a*, 2*b* and 2*c* only over part of the surface. When using the connection provided by the triangular spacer element 9 shown in FIG. 10, the bearing points, disadvantageously, are located only in the outer peripheral region of the flame barrier element 2.

The use of the spacer element 5 according to the invention, which rests uniformly over the entire surface of the corresponding flame barrier element 2, increases the stability of the flame barrier component and ensures a constant space between the adjacent flame barrier components even under a compressive load.

What is claimed is:

1. Flame barrier arrangement (1), having at least two flame barrier elements (2) which are arranged one behind the other in a direction flow of a combustible gas and have a multiplicity of gaps for extinguishing a flame impinging on the surface of a flame barrier element (2) of said two flame barrier elements, and having at least one spacer element (5) between said two flame barrier elements (2), in order to produce a space between said two flame barrier elements (2), wherein one spacer element (5) is securely joined, at least at certain points, to the surface of a flame barrier element (2) of said two flame barrier elements, wherein the spacer element (5) is shaped in such a way that it forms bearing points which are distributed over the entire surface of the corresponding flame barrier element (2) and provides element (2) under a compressive load, wherein the bearing points of the spacer element (5) are distributed uniformly over the surface of the corresponding flame barrier element (2), and wherein the spacer element (5) is in grid form.

2. Flame barrier arrangement (1) according to claim 1 wherein the spacer element (5) is formed from round rods.

3. Flame barrier arrangement (1) according to claim 2 wherein the spacer element (5) is a wire grid or woven wire fabric.

4. Flame barrier arrangement (1) according to claim 1 wherein said at least one spacer element (5) includes a plurality of spacer elements and the spacer elements (5) are in each case spot-welded to the surface of an associated flame barrier element (2).

5. Flame barrier arrangement (1) having at least two flame barrier elements (2) which are arranged one behind the other in a direction flow of a combustible gas and have a multiplicity of gaps for extinguishing a flame impinging on the surface of a flame barrier element (2) of said two flame barrier elements, and having at least one spacer element (5) between said two flame barrier elements (2), in order to produce a space between said two flame barrier elements (2), wherein one spacer element (5) is securely joined, at least at certain points, to the surface of a flame barrier element (2) of said two flame barrier elements, wherein the spacer element (5) is shaped in such a way that it forms bearing points which are distributed over the entire surface of the corresponding flame barrier element (2) and provides element (2) under a compressive load, wherein the bearing points of the spacer element (5) are distributed uniformly over the surface of the corresponding flame barrier element (2), and wherein the spacer element (5) is a wire grid or woven wire fabric.

6. Flame barrier component having a flame barrier element (1) with a multiplicity of gaps for extinguishing a flame impinging on the surface of the flame barrier element (2), and a spacer element (5) which is securely joined to the surface of the flame barrier element, wherein the spacer element (5) is shaped in such a way that it forms bearing points which are distributed over the entire surface of the flame barrier element (2) and provides increased resistance to bending of the flame barrier elements (2) under a compressive load, wherein the bearing points of the spacer element (5) are distributed uniformly over the surface of the flame barrier element (2), and wherein the spacer element (5) is in grid form.

7. Flame barrier component according to claim 6 wherein the spacer element (5) is a wire grid or a woven wire fabric.

8. Flame barrier component according to claim 6 wherein the spacer element (5) is formed from round rods.

9. Flame barrier component according to claim 8 wherein the spacer element (5) is a wire grid or a woven fabric.

10. Flame barrier component according to claim 6 wherein said at least one spacer element (5) includes a plurality of spacer elements and the spacer elements are in each case spot-welded to the surface of the flame barrier element (2).

11. A flame barrier, comprising:

a housing;

at least two flame barrier elements positioned within said housing each of which has a forward surface which will be exposed to a flame, a rearward surface, and a peripheral edge, and wherein each barrier element has a multiplicity of gaps extending from said forward surface to said rearward surface for extinguishing a flame impinging on said forward, said two flame barrier elements configured in parallel such that a forward surface of a first flame barrier element is adjacent to a rearward surface of a second flame barrier element of said two flame barrier elements;

a spacer element joined to one of said forward and rearward surfaces of at least one of said two flame barrier elements at multiple bearing locations distributed uniformly over said one of said forward and rearward surfaces, said spacer element being of sufficient rigidity to withstand bending from a compressive load from a detonation front, said spacer element spacing said forward surface of said first flame barrier element away from said rearward surface of said second flame barrier element; and a connector which passes through said two flame barrier elements and holds flame barrier elements within said housing, said connector being selectively disengageable to allow withdrawal and replacement of at least one of said two flame barrier elements.

12. The flame barrier of claim 11 wherein said connector passes through a central section of said two flame barrier elements and is operably connected to said housing.

* * * * *